United States Patent [19]

Hahn

[11] Patent Number: 4,776,638

[45] Date of Patent: Oct. 11, 1988

[54] METHOD AND APPARATUS FOR CONVERSION OF COAL IN SITU

[75] Inventor: Ottfried J. Hahn, Lexington, Ky.

[73] Assignee: University of Kentucky Research Foundation, Lexington, Ky.

[21] Appl. No.: 72,679

[22] Filed: Jul. 13, 1987

[51] Int. Cl.[4] ..... E21C 43/00; E21C 37/18; E21B 7/15

[52] U.S. Cl. ..... 299/5; 299/2; 299/7; 299/6; 299/14; 175/11; 175/15; 175/16; 48/DIG. 6; 166/248; 166/257; 166/261

[58] Field of Search ..... 299/1, 2, 3, 5, 6, 7, 299/14, 16; 175/11, 12, 15, 16; 166/256, 248, 257, 260, 261; 48/DIG. 6; 208/402; 204/157.15

[56] References Cited

U.S. PATENT DOCUMENTS

| | | | |
|---|---|---|---|
| 2,742,555 | 4/1956 | Murray | 175/16 |
| 2,795,279 | 6/1957 | Sarapuu . | |
| 2,953,353 | 9/1960 | Allen | 175/16 |
| 3,106,244 | 10/1963 | Parker . | |
| 3,169,577 | 2/1965 | Sarapuu . | |
| 4,010,801 | 3/1977 | Terry | 166/257 X |
| 4,067,390 | 1/1978 | Camacho et al. | 166/302 |
| 4,168,752 | 9/1979 | Sabol | 175/12 |
| 4,169,506 | 10/1979 | Berry | 299/2 X |
| 4,185,692 | 1/1980 | Terry | 166/261 X |
| 4,301,875 | 11/1981 | Munding et al. | 175/12 |
| 4,304,308 | 12/1981 | Munding et al. | 299/14 X |
| 4,479,540 | 10/1984 | Grenier | 166/260 |

OTHER PUBLICATIONS

"A Fresh Try and Underground Gasification", Apr. 1951 *Chemical Engineering.*

"Coal Conversion in an Electric Arc", Jun. 1964 *Chemical Engineering Progress.*

*Primary Examiner*—Jerome W. Massie
*Assistant Examiner*—Bruce M. Kisliuk
*Attorney, Agent, or Firm*—King and Schickli

[57] ABSTRACT

A method for the electro-thermal and electrochemical underground conversion of coal into oil and by-products comprises the steps of inserting an underground probe into a bore hole until the probe is in close proximity to a coal seam. A mixture of air, steam, an electrolyte and a suitable catalyst is supplied to the probe, and the mixture is then sprayed directly on the coal seam through a passage in a nozzle. The probe is also energized with electricity applied to the nozzle to produce an arc between the coal and the probe, simultaneous with the spraying of the mixture on the coal seam. Heat of the combustion from the arc and the steam combine to produce a pyrolysis, oxidation, and reduction of the coal, thereby converting the coal into a gaseous combination of oil and by-products. The arc can be rotated to increase the tunnel diameter. An apparatus for performing the method is also provided.

18 Claims, 6 Drawing Sheets

FIG. 8
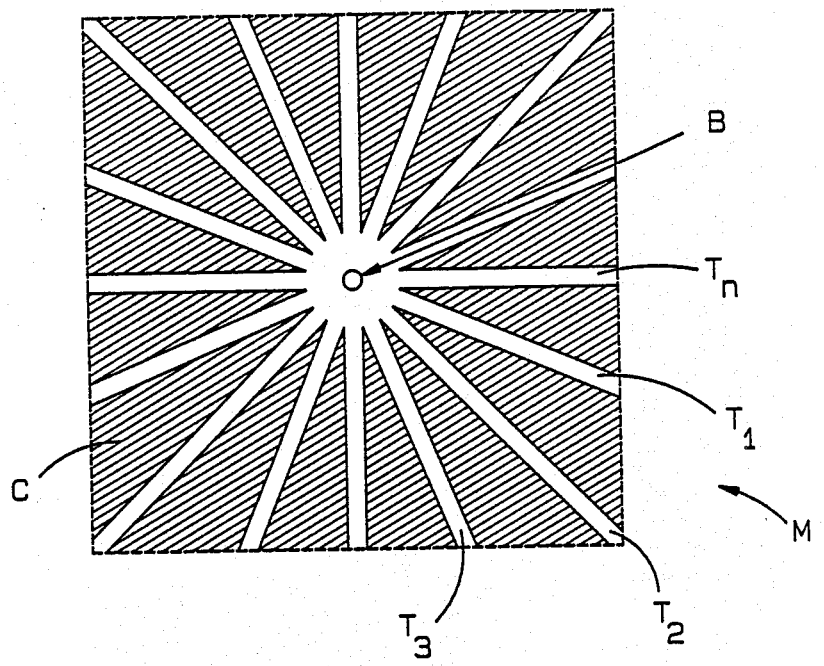
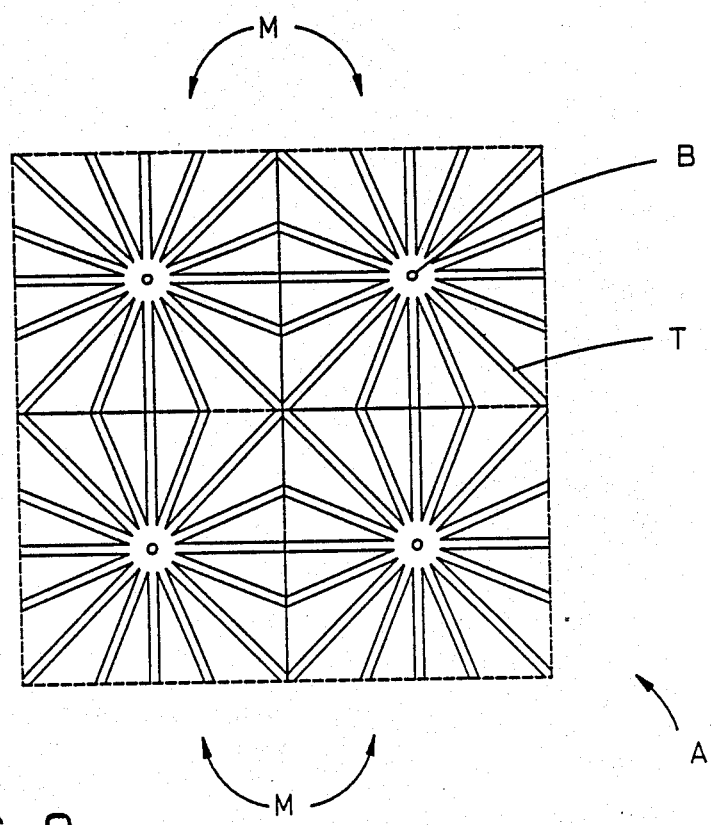
FIG. 9

METHOD AND APPARATUS FOR CONVERSION OF COAL IN SITU

TECHNICAL FIELD

This invention relates generally to the conversion of coal and, more particularly, to a method and apparatus for the combined electro-thermal electro-chemical in situ conversion of coal and into saleable oil and by-products.

BACKGROUND OF THE INVENTION

Various approaches for the conversion of coal to oil, gas and other chemical by-products have been under development since the mid 1800's. Conversion approaches utilizing electricity have generally been limited to either an electro-chemical process or an electro-thermal gasification scheme.

The first work on electro-chemical coal conversion was reported in the late 1800's by Bartoli. This and later electro-chemical studies have emphasized the conversion in aqueous solution using acids and other catalysts. These catalysts promote oxidation and reduction reactions that lead to the conversion of the coal.

While the electro-chemical processes have been shown to successfully convert coal to oil, gas and related by-products, they, disadvantageously, proceed slowly. Further, up to this point in time, electro-chemical processes have only been utilized for above ground conversion and have not been adapted for utilization on coal in situ. As a consequence, conversion of coal by electro-chemical processes have not proved economically feasible. This is primarily due to the cost of first winning the coal and then transporting the coal to the conversion site and finally processing the coal for subsequent electro-chemical conversion.

The additional winning, transporting and processing expenses inherent in prior art electro-chemical conversion methods may be avoided if the coal is converted in situ. Such alternative underground conversion methods have been under study in the United States since about the 1950's.

To the best of this inventor's knowledge, the underground conversion techniques that have been heretofore developed relate primarily to electro-thermal gasification schemes. These schemes utilize electricity as a heat source.

One of the first successful approaches is disclosed in the article, "A Fresh Try at Underground Gasification" appearing in the April, 1951 issue of "Chemical Engineering". Stainless steel pipe electrodes are driven from the surface down into the coal seam. During the first stage of the two stage process, an electric current is passed between the electrodes and the coal is heated by its own electrical resistance. As the coal carbonizes, coal gases are released. These gases pass through perforations into the pipe electrodes and then up through the pipes where they are collected at the surface.

During the second stage of the process air, oxygen and/or steam is passed down through the pipe electrodes and through channels in the coal seam previously created during the first stage. The carbonized coal or coke is ignited and the producer gas that is formed is recovered through the electrode pipes as described above.

While coal is successfully converted utilizing this method, it suffers from a number of disadvantages that have prevented its effective commercialization. The electrical current passing between the electrodes follows the path of least resistance through the coal seam. Thus, the current follows an unpredictable path along moisture pockets and crevices in the coal. This results in random, uncontrolled tunnel formation. Often the resulting tunnel formation leads directly to undesirable patterns of subsidence.

Another technique of electro-thermal gasification designed to avoid this problem is disclosed in U.S. Pat. No. 4,067,390 to Camacho, et al. This patent relates to the application of a plasma arc underground in a coal seam to produce acetylene and other by-products.

The method utilizes a plasma torch including inner and outer concentrically disposed electrodes of opposite polarity. A gas is heated by passing through the annular arc path between the electrodes within the torch. The heated gas is then applied to the coal seam to facilitate coal conversion.

By controlling the movement of the plasma torch, more control and predictable tunneling is possible. Still, the Camacho method shares a number of other disadvantages with the previously discussed electro-thermal gasification method disclosed in the 1951 "Chemical Engineering" article.

Both processes are vulnerable to uncontrolled fires within the coal seam. These fires result from excessive heating of the coal by the applied electric potential combined with available or supplied air or oxygen. Another significant disadvantage of these electro-thermal gasification methods relates to their detrimental impact upon the natural environment. Excess contaminated water from the mined areas often seeps back into and pollutes the ground water.

In addition, these techniques lead to undesirable leakage of volatile gases that are left trapped within the coal seam. Not only do these present a subsequent explosion hazard, but they are indicative of product extraction losses and the low recovery efficiency possible with these methods. A need is therefore identified for an improved, more efficient method for the in situ conversion of coal.

SUMMARY OF THE INVENTION

Accordingly, it is a primary object of the present invention to provide a method and an apparatus for the underground conversion of coal overcoming the above-described limitations and disadvantages of the prior art.

Another object of the present invention is to provide a method for the controlled underground conversion of coal substantially eliminating the possibility of underground coal seam fires while also minimizing subsidence of overburden and the associated degradation of the land surface terrain.

An additional object of the present invention is to provide a method and apparatus for the underground conversion of coal that minimize product extraction losses and optimally utilize substantially all the energy products produced by the conversion.

Still another object of the present invention is to provide a method for the underground conversion of coal that may be implemented with a relatively low capital investment.

Yet another object of the present invention is to provide a method and apparatus for the combined electro-thermal and electro-chemical in situ conversion of coal for a more efficient and economical conversion of coal into saleable oil and by-products.

Another object of the present invention is to provide a method and apparatus for the underground conversion of coal that minimizes contamination of ground water near the conversion site.

Additional objects, advantages and other novel features of the invention will be set forth in part in the description that follows, and in part will become apparent to those skilled in the art upon examination of the following, or may be learned with the practice of the invention. The objects and advantages of the invention may be realized and attained by means of the instrumentalities and combinations particularly pointed out in the appended claims.

In order to achieve the foregoing and other objects, and in accordance with the purposes of the present invention as described herein, a method is provided for the underground conversion of coal. The method includes the step of inserting a conversion probe into a bore hole until the probe is in close proximity to a coal seam. Next is the supplying of a mixture of air, steam, electrolyte and catalyst to the probe. At substantially the same time, an electrical arc is produced directly between the probe and the coal seam by energizing an electrode of the probe with electricity. The heat of combustion with the oxygen and from the arc combine with the electrolyte catalyst and steam to produce a pyrolysis, an oxidation and a reduction of the coal. This combined electro-thermal and electro-chemical process operates synergistically to move efficiently convert the coal into light oils and by-products. The combination of oil, gaseous carrier and/or by-products is then extracted from the bore hole.

More specifically, the probe is advanced in a substantially horizontal direction into and through the coal seam during conversion. A tunnel results as the coal is converted by the probe. In order to minimize subsidence, a pattern of tunnels is preferably produced during conversion. More specifically, a star pattern is formed by directing the probe so as to convert coal in a number of different radial directions from the bore hole. The coal seam between the resulting tunnels is left undisturbed to provide support for the overburden and thereby minimize subsidence. Of course, the star pattern of tunnels may be repeated over a large area to economically convert coal with minimal damage to the surface environment.

In order to provide improved conversion efficiency, the method of the present invention includes the additional step of rotating the electric arc. In this manner, coal conversion proceeds in a uniform manner all about the probe as it is advanced through the seam. Advantageously, the coal seam is uniformly converted. This results in the maximum production of oil and other by-products from the coal. The rotating arc also substantially eliminates the potential for overheating of one area of the seam with the arc and the resulting reduction in coal conversion as well as underground fire hazard.

The lighter by-products of the conversion are carried by the steam to the well bore. These products are extracted from the well bore and brought to the surface as, for example, by means of a pump. There the method includes the step of separating the oil and by-products. This is accomplished by condensing the gaseous combination in a condensor to yield oil, water in a liquid form and the by-products in a gaseous form.

In order to provide maximum efficiency, the gaseous by-products formed in the conversion may be combusted on site to produce the electricity for the energizing of the probe. In addition, the steam for the process may be produced by using the waste heat from the combustion step for heating water in a boiler. The resulting steam that is produced is supplied to the probe for spraying underground on the coal.

In accordance with yet another aspect of the present invention, an apparatus for the underground conversion of coal is provided. The apparatus includes a conversion probe to efficiently convert coal in situ to oil and other by-products. Means are also provided for inserting the probe into the bore hole until the probe is in close proximity to the coal seam.

The apparatus further includes means, such as spray jets, for spraying a mixture of air, steam and chemicals directly on the coal seam. Preferably, the chemicals include an electrolyte and a catalyst for the electrochemical conversion of the coal. The electrolyte is an acid that may be selected from the group consisting of nitric acid, sulphuric acid and hydrochloric acid. Other acids may, however, be utilized. In addition, the catalyst is preferably selected from a group consisting of iron oxide, potassium salts, cobalt salts and calcium salts. Other catalysts known in the art may, however, also be utilized.

The probe is also provided with means for producing an electric arc between the probe and the coal seam. Together, the electric arc and the spray mixture convert the coal through electro-chemical and electro-thermal reactions into a gaseous combination of oil and by-products.

Preferably, the apparatus also includes a means, such as a drill string, for advancing the probe from the bore hole substantially horizontally so as to form a tunnel in the coal seam as the coal is converted. In addition, the apparatus is provided with means for rotating the electric arc. As discussed above, the rotation of the arc improves the conversion efficiency of the probe through the direct application of the arc about the entire circumference of the probe.

Preferably, the probe is also equipped with a means for monitoring the position of the probe within the coal seam. Thus, the probe may be positively directed to produce a set pattern of tunnels adapted to substantially eliminate or minimize subsidence of the overburden. The monitoring means includes a plurality of sonic sensors mounted to the probe. A computer control system interprets the output of the sonic sensors to provide the operator with the present operating position of the probe.

In order to assure that the probe is maintained in the coal seam during conversion, a means is provided for automatically centering the probe within the tunnel produced in the coal as it is converted.

Further, the apparatus is provided with a means for pumping excess water accumulating in the bore hole from condensed steam and subterranean sources out of the bore hole. The water from the bore hole may be filtered to eliminate not only the catalyst and electrolyte used in the conversion process, but also the resulting oil and by-products as well as any acids or other materials leaching from the underground strata due to the action of the underground conversion. Thus, pollution of the ground water in the area of the conversion site may be advantageously minimized.

Still other objects of the present invention will become readily apparent to those skilled in this art from the following description wherein there is shown and described the preferred embodiment of this invention, simply by way of illustration of one of the modes and alternative embodiments best suited to carry out the invention. As it will be realized, the invention is capable of other different embodiments, and its several details are capable of modifications in various, obvious aspects, all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrate several aspects of the present invention and together with the description serve to explain the principles of the invention. In the drawings:

FIGS. 8 and 9 are identical representations showing star coal conversion patterns in a coal seam utilizing the apparatus and method of the present invention.

Figure 1:
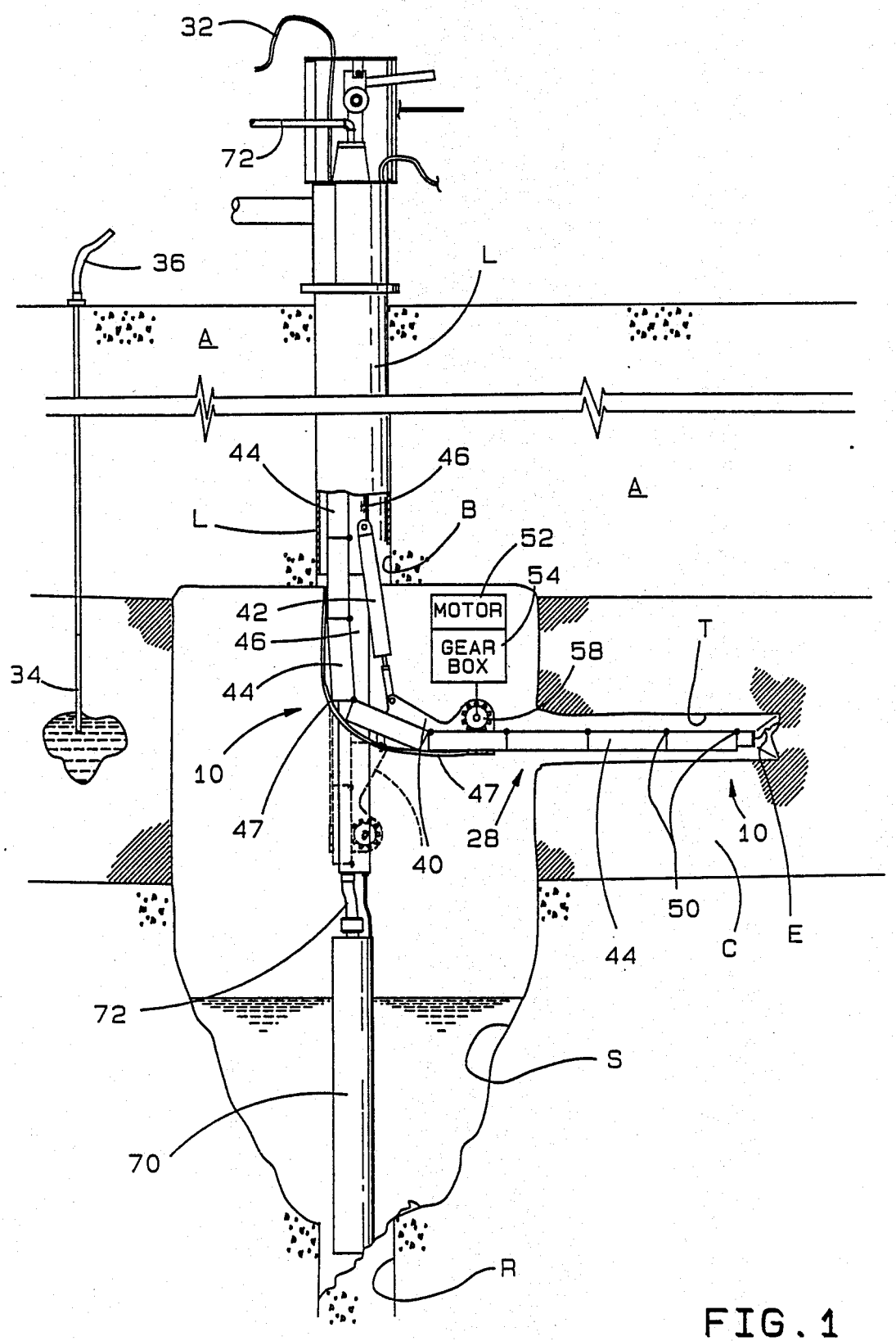
FIG. 1 is a schematical representation of the apparatus of the present invention converting coal in a coal seam.

Reference will now be made in detail to the present preferred embodiment of the invention, an example of which is illustrated in the accompanying drawings.

DETAILED DESCRIPTION OF THE INVENTION

Reference is now made to the drawing figures illustrating the apparatus and method of the present invention. By substantially simultaneously applying an electric arc and a mixture of steam, air, electrolyte and catalyst to the coal seam C, coal is converted both electro-thermally and electro-chemically into a combination of oil, gaseous carrier and/or by-products. The conversion proceeds with a marked improvement in efficiency due to the synergistic interaction between these two conversion techniques. Additionally, hazards characteristic of previous conversion methods, such as, uncontrolled underground fires, severe and uncontrolled subsidence of overburden and extreme water pollution, are substantially eliminated and even avoided.

The method of the present invention includes the step of inserting a conversion probe 10 into a bore hole B until the distal end of the probe is in close proximity to a coal seam C (see FIG. 1). In order to do this, the drilling site is prepared by conventional means. A bore hole B is drilled from the surface through the overburden A and into the coal seam C. The bore hole B is preferably extended beneath the coal seam to provide a rat hole R for collecting debris created during this site preparation, as well as condensation and other by-products created during actual conversion.

The bore hole B is lined with a metal casing L that extends through the upper layer of overburden to prevent collapse of the overburden into the lower reaches of the bore hole. The metal casing L also advantageously provides a relatively clean surface for extraction of the oil, gaseous carrier and by-products produced during the conversion. In FIG. 1, a portion of the casing L is broken away adjacent the bottom of the bore hole B, and below that a portion of the probe 10 is broken away, for clarity of showing the relationship between the parts.

Preferably, a conventional cornering water jet drill (not shown) is used to prepare the bore hole B in the region of the coal seam C. The water jet enlarges the diameter of the bore hole B so as to form an under reamed cavity. Preferably, the under reamed cavity is extended beneath the coal seam C so as to provide a water collection sump area S. The diameter of the under reamed cavity portion of the bore hole B is also made sufficiently large to allow the conversion probe 10 to swing from the vertical plane, as oriented for insertion through the metal casing L, to a horizontal plane for subsequent conversion of the coal in the seam C. FIG. 1 illustrates the distal end of the conversion probe 10 located substantially in the horizontal plane ready for conversion; the vertical insertion position being shown in dashed-line form.

After the bore hole B has been prepared as described, the conventional drill is removed and the bore hole B is lined. The conversion probe 10 is then inserted vertically into the bore hole, turned and advanced substantially horizontally so as to be positioned in close proximity to the coal seam C.

Figure 2:
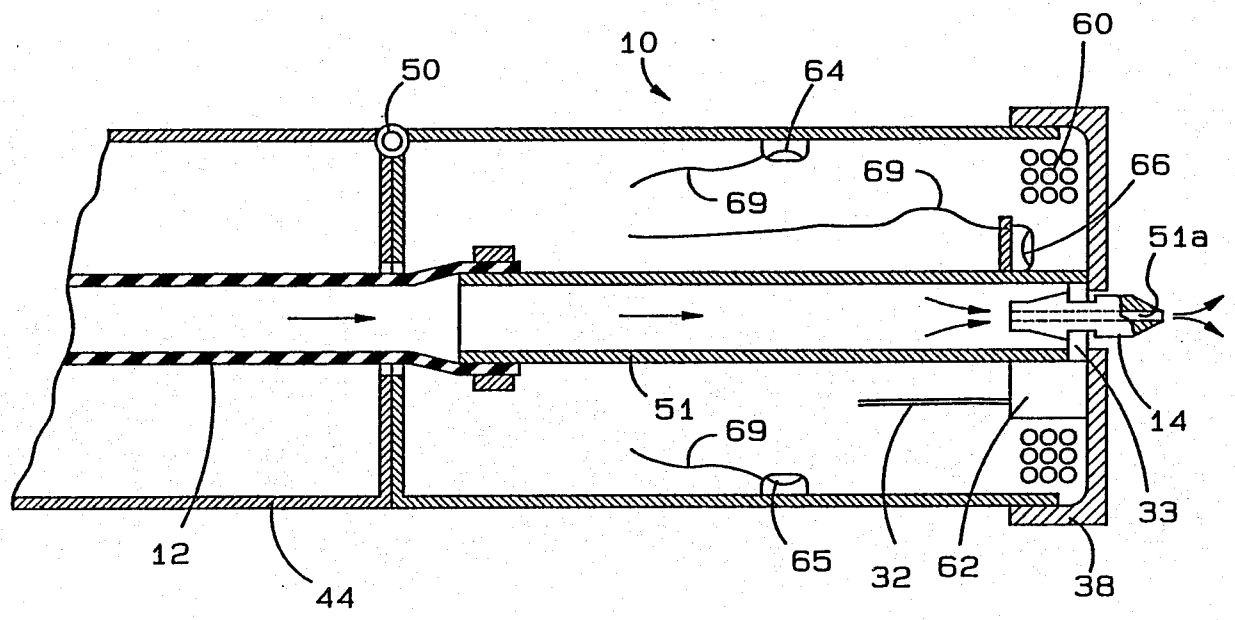
FIG. 2 is an enlarged cross-section of the probe of the present apparatus.

Once positioned, a mixture of air, steam, electrolyte and catalyst is supplied to the probe 10 through a feed supply line 12 (see FIG. 2). The mixture is sprayed directly onto the coal seam C through a nozzle 14. The mixture, in the form of a vapor, disperses radially outward when it leaves the nozzle 14, and is thereby applied to a substantially large area of the coal seam C in front of the probe 10. By adjusting the air and steam ratios and the distance between the nozzle 14 and the coal seam C, a controlled area or reaction zone of from 8–10 feet in diameter may be sprayed with the vapor mixture.

At substantially the same time spraying occurs, an electric arc is produced between the probe 10 and the coal seam C. As best appreciated from viewing FIG. 2, the nozzle 14 also functions as an electrode. The arc is initiated by bringing the nozzle electrode 14 into close proximity with a coal seam (i.e. within about one inch (1"). Preferably, the nozzle electrode 14 is constructed of thoriated tungsten for maximum operational efficiency. Once the arc is initiated, the nozzle is pulled back to allow the arc to contact more coal.

The simultaneous application of the vapor mixture and arc to the coal seam C results in conversion of the coal. More specifically, the arc heat of combustion and the steam combine to convert the coal by pyrolysis as well as oxidation and reduction, as discussed in greater detail below.

The actual conversion of coal in the seam C into oil and gaseous by-products occurs in a primary gasification reaction zone. The reaction zone is in the region where the electric arc from the probe 10 strikes the coal. Since the arc directly strikes the coal, maximum heating efficiency is achieved. The temperature of the coal as heated by the arc exceeds the coal gasification temperature. Thus, the coal is converted—the heavy tars and oils being released. Advantageously, however, the elevated temperature is maintained only for a short duration. This is due to the quenching effects produced by the substantially simultaneous spraying of the mixture of air, steam and chemicals onto the coal seam C. In this way, underground fires characteristic of prior art electro-thermal conversion approaches are avoided. The temperature variation does, however, permit the pyrolysis of a substantial amount of the coal at the head of the probe.

As the arc passes through the steam, it produces H+ and HO− ions. These ions interact with the heavy tars and oils produced by the pyrolysis, and through oxidation and reduction reactions reduce their molecular weight. The excess steam available then carries the pyrolysis products (i.e. the oil and the gases) out through the tunnel produced by the conversion and upward through the bore hole B. Thus, the excess steam actually facilitates the extracting of the oil and by-products from underground. Various pumping systems may, of course, also be utilized to enhance the efficiency of the extracting step.

Figure 3:
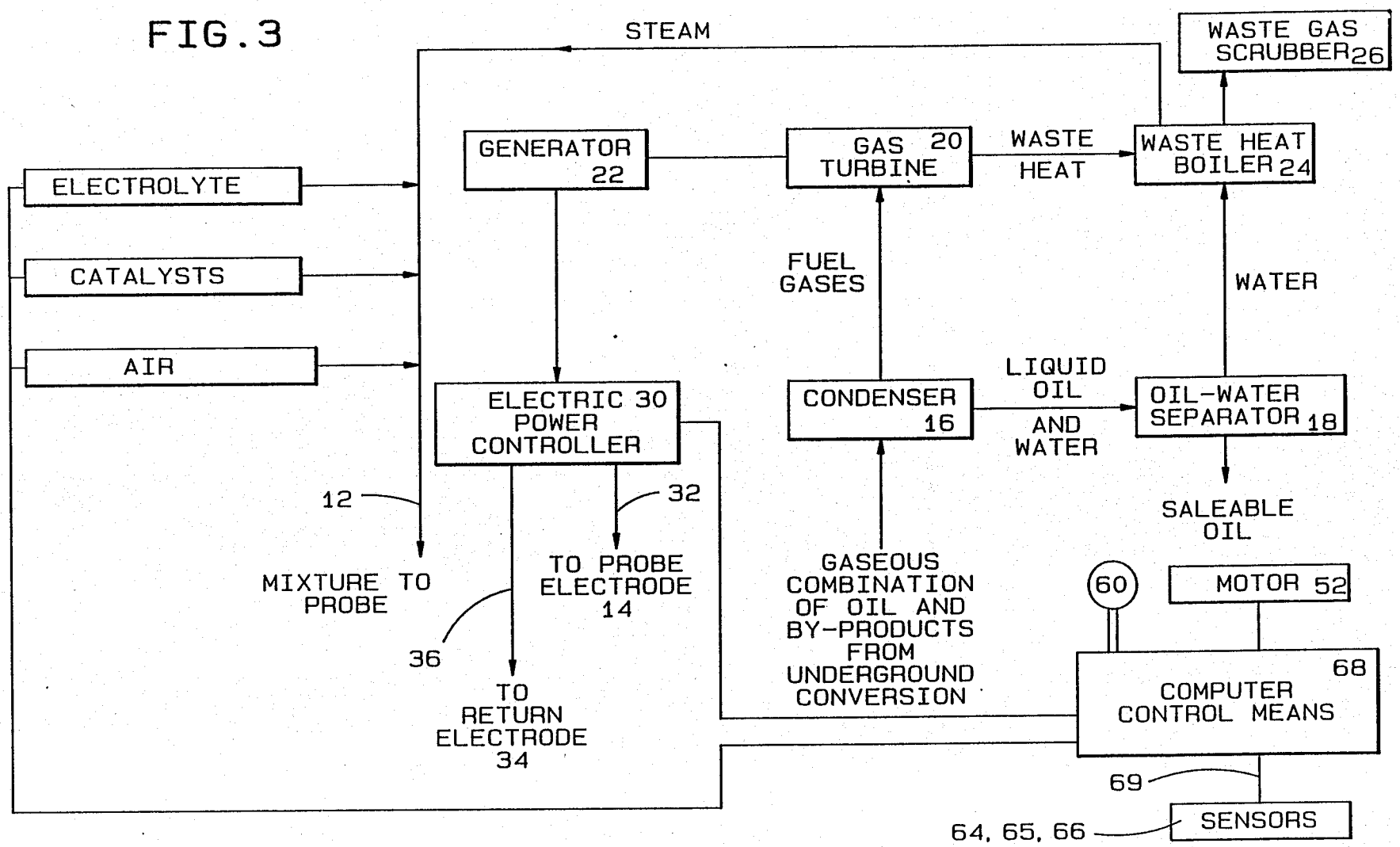
FIG. 3 is a schematic flow diagram of the process and illustrating the control circuit and flow of fluids through the apparatus of the present invention.

The oil and by-products extracted from the bore hole B are first separated by passing them through a condensor 16, as shown in FIG. 3. The condensor 16 yields oil and water in liquid form and other by-products in gaseous form. The oil and water are delivered to an an oil/water separator 18. Oil has a lighter density than water. As is generally known in the art, the oil/water separator 18 utilizes this difference in density for separation. The oil thus separated is saleable, and may be placed in containers and transported to further processing facilities as desired.

Overall increased system efficiency is obtained by utilizing all of the energy products extracted from the coal during conversion. To accomplish this, the gaseous by-products are delivered from the condensor 16 for combustion in a gas turbine 20. The gas turbine 20 is used to drive a generator 22 to produce electricity for energizing the nozzle electrode 14 of the probe 10 and producing the arc.

To further improve the efficiency of the system, waste heat produced by the gas turbine during the combustion of the by-products is collected and delivered to a waste heat boiler 24. There the waste heat is utilized to heat water recycled from the oil/water separator 18. The water is, of course, first treated for proper boiler operation. The steam that is produced is then delivered along the feed supply line 12 (see FIGS. 2 and 3) with appropriate quantities of electrolyte, catalyst and compressed air for spraying through the nozzle electrode 14 onto the coal seam. Of course, after heating the water in the boiler 24, the waste heat gases are passed through a scrubber 26 to remove any remaining pollutants before releasing the gases to the atmosphere.

As coal is converted, the probe 10 is advanced away from the bore hole B through the substantially horizontal coal seam C by means of a supporting drill string 28. A tunnel T is formed in the seam C as the coal is converted and the probe continually advanced. Maximum conversion efficiency is realized during advancing of the probe by rotating the electric arc extending from the nozzle electrode 14 to the coal seam C. Through this rotation, the electric arc is applied with the steam mixture in a more uniform manner and to a larger surface of the coal seam for increased coal conversion.

Advantageously, large areas of a coal deposit may be safely and efficiently converted to oil and by-products utilizing the method of the present invention. More specifically, this is done by withdrawing the probe 10 back through the tunnel T to the bore hole B after conversion cycle. There, the probe 10 is turned, the cycle is repeated and a new tunnel T is formed in a different radial direction. As the probe 10 is advanced, the non-coverted coal between the tunnels T is left undisturbed so as to support the overburden and reduce subsidence (see FIG. 8).

From a single bore hole B, the total number of tunnels T, that may be formed, that is the total amount of coal that may be converted, is limited by the strength of the coal seam left remaining between the tunnels near the initial bore hole. For example, if subsidence near the bore hole is of relatively little concern, more tunnels may be initiated from each bore hole.

As shown in FIG. 8, the series of tunnels emanating from a single bore hole form a star pattern with the bore hole substantially at the center. The length of these tunnels T is limited by the mechanical constraints of the probe apparatus employed, or more practically, by the desired conversion efficiency. That is, to most efficiently convert the coal seam C, while working within the constraints imposed by subsidence at the bore hole, shorter tunnels are used so that only a minimum amount of coal is left undisturbed between the furthest ends of two adjacent tunnels. A trade-off is imposed between removing the optimum or maximum amount of coal and retaining sufficient coal in situ to prevent subsidence. With this in mind, tunnels of 100 to 150 feet in length are quite feasible.

This optimal conversion efficiency can be realized by the additional step of extending the tunnels T until a rectangular area of the coal seam has been converted (again, see FIG. 8). This results in a modified star pattern M of tunnels being formed.

Thus, to most efficiently convert large areas of a coal seam, a further step involves the drilling of additional bore holes. These additional bore holes are strategically placed to allow duplicating of the modified star pattern M from each bore hole. This results in modified star patterns that are contiguous, as shown in FIG. 9. The additional step of drilling the additional bore holes and duplicating the modified star pattern M allows coal to be converted in a uniform manner over a larger area of the coal seam. Advantageously, this is done while maximizing coal recovery and minimizing subsidence of the overburden.

The apparatus for performing the above-described method is shown in detail in FIGS. 1, 2 and 3. The probe 10 includes an electrode 14 at the distal end. This electrode 14 is connected to receive power from the generator 22 through an electric power controller 30 located at the surface, and shown schematically in FIG. 3. The connection from the generator and controller is made by a conductor 32 and a retractable anchor pin 33 (see FIG. 2) that is received in a circumferential groove in the electrode 14 to hold the electrode in position. On the opposite side of the electrode is a stationary, semicircular retainer that is also received in the groove of the electrode 14.

A return electrode 34 is driven into the coal seam C from the surface (see FIG. 1). The return electrode 34 is also connected to the electric power controller 30 by a conductor 36. In operation, an electric arc E is generated between the electrode 14 and the coal seam C to complete the current path. An insulating ceramic cover 38 (FIG. 2) on the head of the probe 10 prevents the arc from striking back against the probe.

Referring back now to FIG. 3, the electric power controller 30 is connected to the generator 22 that is driven by a turbine 20 as described above. The generator 22 may, for example, be a commercially available D.C. generator rated at 2,000 volts.

Preferably, the probe electrode 14 is negatively biased to act as the cathode while the coal seam C is positively biased by the return electrode 34 to act as an anode. This straight polarity configuration provides a deeper arc penetration into the coal seam over a smaller area than the reverse polarity would provide. Thus, the arc heat at the coal seam C is limited to a relatively small area substantially reducing the risk of initiating an uncontrolled underground fire. In addition, the increased depth of arc penetration increases conversion efficiency. Further, straight polarity concentrates approximately 70% of the arc heat in the coal seam C leaving only 30% in the probe electrode 14. Hence, electrode temperature and thus consumption is minimized. Consequently, each electrode 14 has a longer surface life.

The probe 10 is inserted into the bore hole B and advanced during conversion by means of a drill string 28, a positioning shoe 40 and a position control means 42. The drill string 28 is comprised of a plurality of hollow, rectangular tubes 44. The rectangular tubes 44 are joined end to end so as to form a substantially continuous protective sleeve from the surface through the bore hole B and tunnel T. The drill string 28 shields and protects the electrode conductor 32, the fluid supply line 12 and other instrumentation cables and control lines leading from the surface along the probe 10. Each tube 44 is hinged at a hinge 50 to the adjacent tube to one side. This allows the drill string 28 to be turned through approximately 90° from the substantially vertical insertion position (shown in dashed line in FIG. 1) to the substantially horizontal position in the tunnel T with the hinge 50 on top (shown in full line in FIG. 1).

A guide frame 46 is utilized to position the drill string 28 and guide it through the metal casing L. The guide frame 46 extends from the surface down to the level of the coal seam C and provides a smooth track (not shown) upon which the drill string 28 travels. The positioning shoe 40 is pivotally suspended on the lower end of the guide frame 46 by a flexible guide ramp 47.

During insertion through the bore hole B, the shoe 40 is directed in a substantially vertical position (see dotted line position of FIG. 1). Upon reaching this level, that is in the coal seam C, the position control means 42, shown as a hydraulic ram, rotates the shoe 40 by flexing the guide ramp 47 through approximately 90° to a substantially horizontal position. The flexible guide ramp 47 allows the drill string 28 to slide easily into and out of position along the tunnel T.

More particularly, as the drill string 28 is advanced down the guide frame 46, the bottom sides of the probe 10 and tubes 44 slideably engage and are turned by the ramp 47. The hinges 50 at the opposite side of the probe 10 pivot and tubes 44 open at the bottom allowing for smooth travel of the probe and drill string 28 from the vertical to the horizontal position. In the horizontal position the probe 10 is ready to begin conversion of the coal.

A mixture of air, steam, electrolyte and catalyst is fed from the surface through drill string 28 of the probe 10 via the flexible supply line 12. The fluid material is fed into the nozzle feed tube 51 connected to the line through a conventional clamping collar (see FIG. 2). The nozzle 14 includes a passageway 51*a* to receive the fluid material from the tube for ejection to the working face (see flow arrows in FIG. 2).

An air compressor (not shown) may be utilized to provide the air portion of the fluid material at a regulated pressure. By adjusting the air pressure, which serves as the main fluid carrier, the pyrolysis of the coal may be controlled and the composition of the conversion products adjusted as described in greater detail below.

The steam is utilized for a number of reasons. Free radicals are produced when the steam is contacted by the electric arc. These free radicals serve to break down the heavy tars and oils created by the pyrolysis of the coal. Further, gasification using steam is not as sensitive to pressure variations in the reaction zone as is gasification in a gaseous medium. The capability to successfully operate over a greater range of pressures is particularly advantageous because the pressure in the reaction zone may vary over a wide range due to the continuous changing tunnel volume as coal is converted. Hence, with the use of steam, no control is required over the pressure existing within the bore hole and the tunnel during operation.

Figure 4:
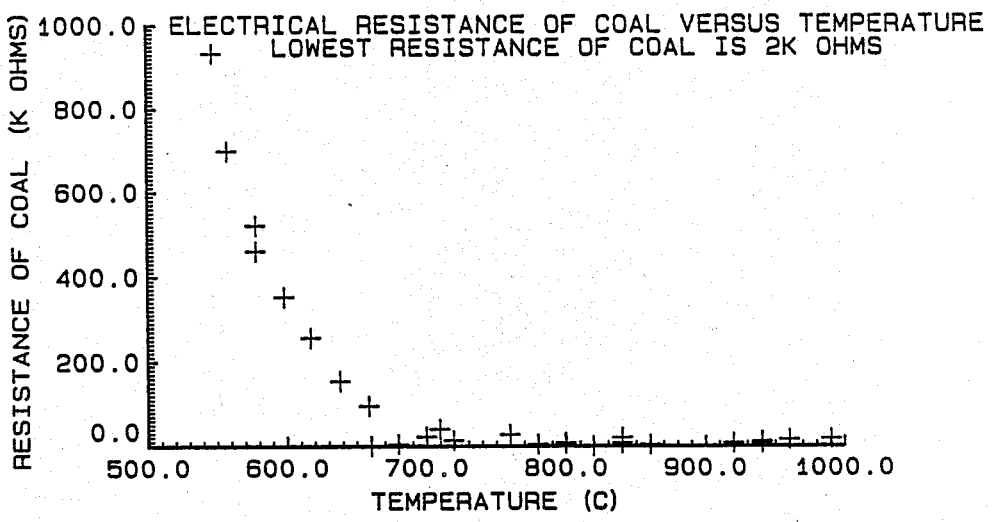
FIG. 4 is a graph of the electrical resistance of coal versus temperature.

Both the electrolyte and catalyst aid in the conversion of the coal. The electrolyte assists in the initiation and maintainance of the electric arc. The electrolyte, when sprayed on the coal, enhances the conductivity of the coal. Thus, the electrolyte plays an especially significant role during arc initiation. To explain further, at coal temperatures below 700° C., the resistivity of coal is relatively high (see FIG. 4). Advantageously, spraying of the electrolyte onto the coal seam C decreases the insulating properties of the coal to a point where the electric arc may be easily initiated. Once initiated, the rising temperatures decrease the electrical resistance of the coal to approximately 2 kilo-ohms (i.e. a level at which the arc is relatively easy to maintain). Suitable electrolytes to assist in arc initiation and maintainance include nitric, sulphuric and hydrochloric acids. Preferably, dilute nitric acid is utilized.

In addition to assisting in arc initiation and maintainance, the nitric acid electrolyte also contributes to the conversion process. The presence of the acid in the reaction zone assists in producing greater quantities of saleable liquid oil. Thus, the nitric acid serves a secondary function as a liquification catalyst.

The primary catalyst added to the spray mixture provides more effective conversion of the coal at the molecular level. The most effective gasification catalysts are the potassium salts although lithium and sodium salts may also be utilized. Conversely, the most effective liquification catalysts are cobalt salts although nickel, yttrium and zinc salts serve a like function. Presently, however, both potassium and cobalt salts are relatively expensive. Thus, to lower operating costs it is necessary to recover or reuse these compounds. The additional apparatus necessary for the recovery of these catalysts from the gaseous combination of oil and by-products is commercially available.

Alternative and less expensive catalysts for use in the present process include iron oxides and calcium. While not as effective as potassium and cobalt salts, in catalyzing conversion, the reduced effectiveness of these catalysts is offset by this relatively low cost. This is particularly true of the iron oxides. More specifically, due to the low cost, recovery of the iron oxides from the resulting oil and by-products is not required. Further, since iron oxide is a more effective liquification catalyst than gasification catalyst, the iron oxides do serve to increase the production of saleable oil products.

The mixture of air, steam, electrolyte and catalyst is sprayed from the probe 10 directly onto the coal seam through the center passage 51*a* of the electrode 14. Advantageously, this spraying serves to both remove heat from the electrode 14 that builds as the arc is maintained as well as assure the spraying of steam rather than condensate. The vaporous mixture disperses evenly as it is expelled through the electrode and thus covers a large area of the coal seam C in front of the probe 10. In this manner, the mixture and the electric arc are simultaneously applied and contact the coal seam C so as to convert the coal with maximum efficiency as described.

As the coal before the probe 10 is converted, the probe is advanced further into the seam C. The mechanism for advancing the probe 10 includes a hydraulic motor 52 and associated gear box 54, shown schematically in FIG. 1. These may be mounted on the positioning shoe 40 and the motor 52 is supplied with pressurized fluid from a line carried on the frame 46.

A chain and sprocket assembly may be utilized to connect the gear box 54 to a drive gear 58. The gear 58 is mounted to shoe 40 above the drill string 28. The gear 58 includes teeth that mesh with a rack comprising evenly spaced holes all along the top of the tubes 44, so as to form a rack and pinion drive. Thus, with the bottom of the tubes 44 supported by the ramp 47 and the shoe 40, the gear 58 advances the probe 10 horizontally through the tunnel T as the coal is converted.

Flexible leaves (not shown) may be provided to center the probe 10 in the tunnel T as it is advanced. A centering system of this type is shown in U.S. Pat. No. 2,248,160 to Crawford and is incorporated herein by reference.

As the probe 10 is advanced, the electric arc between the probe electrode 14 and the coal seam C is rotated. Preferably, the arc is rotated at a rate between 5 and 400 cycles per second. The slower the rate of rotation, the larger the area heated by the arc. By means of the rotation the arc is caused to contact a larger area of the coal so as to increase coal conversion efficiency. In addition, since the arc is constantly moving, the possibility of overheating the coal in one area is reduced and the potential for causing a self sustaining underground fire is substantially eliminated.

An electric coil 60 is provided in the head of the probe 10 adjacent to the electrode 14 (see FIG. 2). When energized, the coil 60 produces a magnetic field that serves to rotate the electric arc emanating from the probe 14. Thus, the arc makes a circular swath across the face of the coal seam C. In this manner, a large diameter tunnel T is formed with a larger quantity of coal being converted than if the arc were static.

At some point during operation, it may become necessary to replace the probe electrode 14. This may be accomplished without removing the probe 10 from the tunnel T. More specifically, the electrode release mechanism 62 shown schematically in FIG. 2, may be activated via a compressed air line or other means. Once activated, the anchor pin 33 is withdrawn from the anchoring groove of the electrode 14. The pressurized mixture of air and steam in the mixture supply line 12 then ejects the used electrode 14 from the probe 10. The anchor pin 33 is then reextended and a new nozzle electrode 14 positioned in the mixture supply line 12 at the surface. The new electrode nozzle 14 is conveyed to the head of the probe 10 through the line 12 by means of the pressurized mixture. Once the nozzle electrode 14 reaches the desired position, the anchor pin 33 snaps into the anchoring groove to hold the new electrode in proper operating position. The probe 10 is then advanced closer to the coal seam to reinitiate the arc and start the conversion process again.

The position of the probe 10 within the tunnel T may be monitored by means of sonic sensors 64–66 (see FIGS. 2 and 3). The sensors 64–66 are mounted to the exterior of the probe housing. The sensors 64–66 are connected to a computer control means 68 on the surface by instrumentation cables 69 to provide feedback concerning the position of the probe within the tunnel T (see also FIG. 1).

The first sonic sensor 64 is mounted along the top surface of the housing. This sensor 64 monitors the vertical distance from the top of the probe to the top of the tunnel T. The second sonic sensor 65 is mounted along the bottom of the housing to monitor the distance of the probe from the bottom surface of the tunnel T. The third sonic sensor 66 is mounted so as to be directed forward from the head of the probe. The sensor 66 is utilized to measure the distance from the head of the probe to the coal seam C. This sensor 66 is particularly useful during arc initiation allowing the operator to monitor the gradual advance of the probe toward the coal seam C until the distance is small enough to allow the arc to be initiated.

As the coal is converted, the saleable oil and gaseous by-products are conveyed by the steam and condensate back from the tunnel T to the bore hole B. Over time, the condensate and water from subterranean sources accumulates in the bore hole B. This water is removed from the bore hole B along with any products and contaminants produced during the conversion process by means of a sump pump 70 (see FIG. 1). Advantageously, removal of this water also serves to minimize seepage through the ground thereby reducing or substantially preventing pollution of area water supplies. Conventional hose 72 carries the water from the sump pump 70 through the bore hole B to the surface. There it may be purified and utilized as make-up water for the waste heat boiler 24. Thus, the recovered water is recycled as steam in the conversion mixture.

Precise control of the conversion process is provided by the computer controlled 68 which controls the mixture composition by regulating the air pressure, steam and quantities of electrolyte and catalyst added to the mixture so as to produce the desired conditions at the reaction zone. The computer controller 68 also controls the arc voltage and the current, as well as the speed of advance of the probe 10 through the tunnel T.

Preferably, the electric arc has a voltage of from 1,000 to 2,000 volts and a current of at least 600 amperes. Arc penetration into the coal seam C is directly proportional to voltage and rate of coal heating is directly proportional to current. Thus, it should be appreciated that an increase in voltage results in an increase in arc penetration into the coal seam C. Similarly, an increase in current results in more rapid heating of the coal.

Further control of the process is possible by monitoring the gaseous by-products of the conversion. This may be done by utilizing a gas chromotograph or any other means known in the art. If, for example, excessive $CO_2$ is present in the gaseous by-products of the conversion, the air or oxygen being supplied for conversion is reduced by the computer.

As another example, if the probe temperature falls below approximately 800° C., this is an indication that there is too much cooling and the steam supply is reduced. In short, by varying the air and steam supply rate, as well as the arc voltage current and rotation rates, the desired reaction products may be obtained.

A number of experiments have been performed to study the behavior of the electrical arc under reaction zone conditions. Specifically, arc resistance has been studied with the results being recorded in terms of the voltage drop per inch of arc length. The length of the arc in the studies was varied from 8–33 inches.

Figure 5:
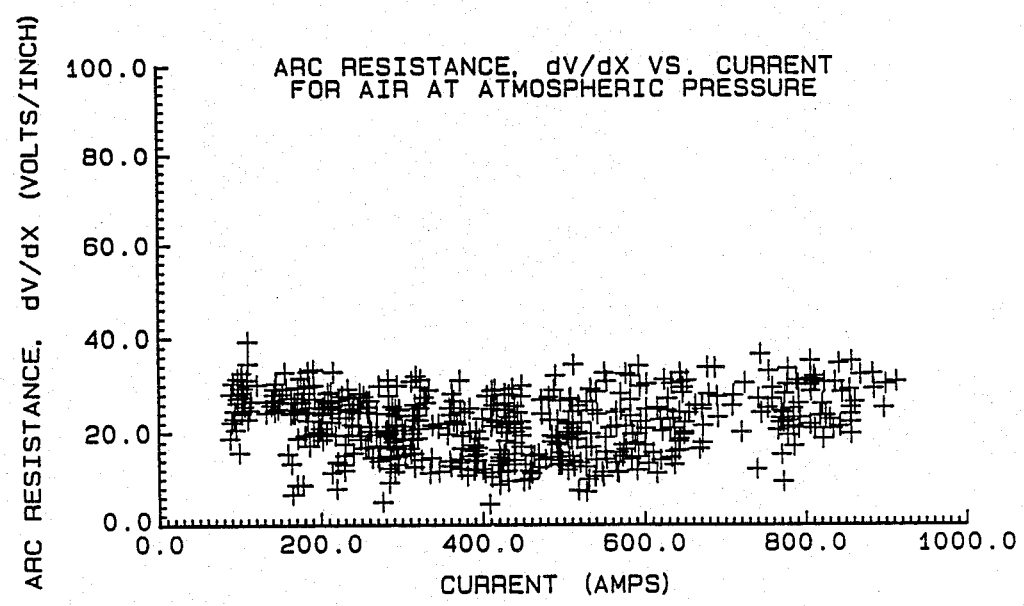
FIGS. 5–7 are graphs of arc resistance under various conditions as set forth in the graph headings.

The arc resistance was studied under three conditions with the results plotted in terms of arc resistance in volts per inch and against the arc current in amperes. FIG. 5 shows arc behavior in air at atmospheric pressure. The voltage drop, or resistance, of the arc range between 5 and 40 volts per inch, with an average of approximately 20 volts per inch.

Figure 6:
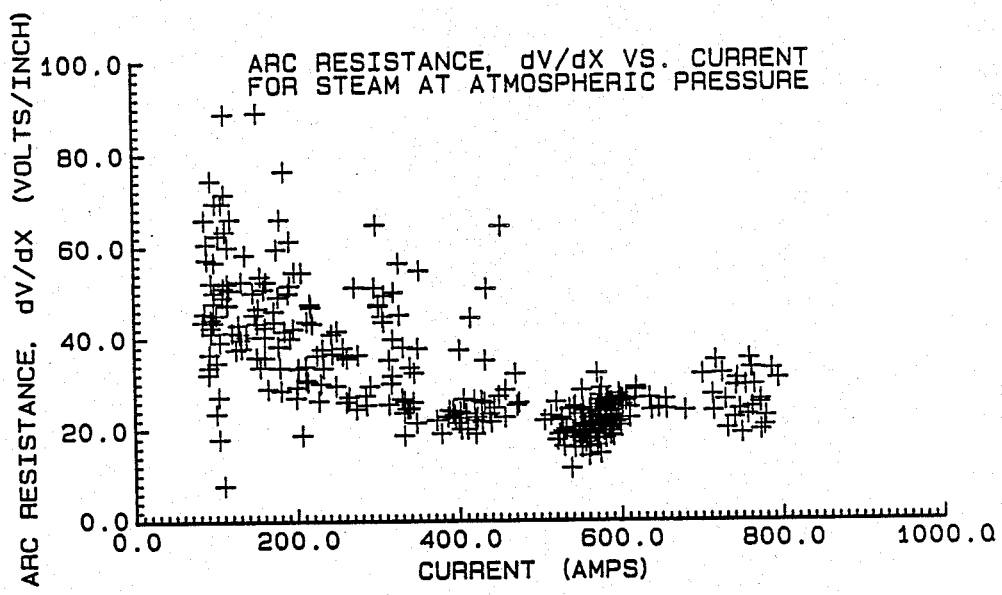

A second study of arc behavior was conducted with steam in the reaction zone at atmospheric pressure. The results, shown in FIG. 6, indicate a wide variation in arc resistance or currents under approximately 500 amperes. However, near 600 amperes the arc behavior in steam is essentially the same as the arc behavior in air at atmospheric pressure. That is, the voltage drops remain between 5 and 40 volts per inch.

Figure 7:
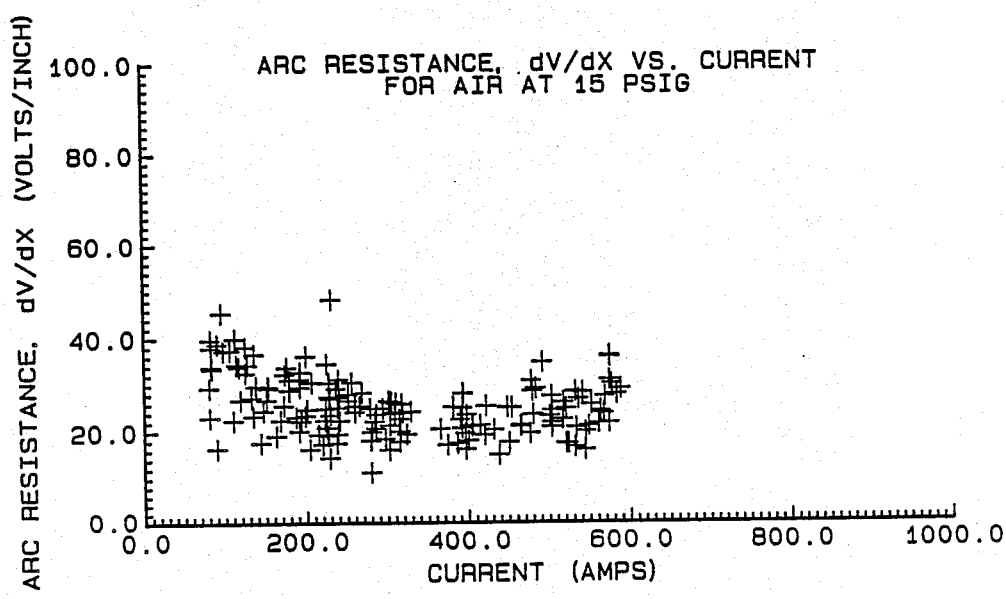

A third study of arc behavior was conducted with air in the reaction zone pressurized to 15 psig. Under these conditions, the scatter of the data points increased as shown in FIG. 7. Whereas in air the atmospheric pressure of the arc resistance ranged from 5–40 volts per inch, the range increased to 12–48 volts per inch in air at 15 psig. This variation in arc resistance, as best understood, is attibutable partially to the continually changing conditions within the reaction zone and to the varying chemical composition of the coal being converted.

These studies of arc behavior under various reaction zone conditions confirm the economic feasibility of the present method. Assuming conditions to be at atmospheric pressure within the reaction zone, with the current level near 600 amperes, the worst case voltage for the arc would be 40 volts per inch. Under these conditions, a 2,000 volt generator could produce an arc that would extend approximately 50 inches (ignoring losses in the electrodes). By including the step of rotating the electric arc within the tunnel T, it can thereby be seen that tunnels up to eight feet in diameter could easily be formed as the coal is converted. Of course, it should also be appreciated that this method is still commercially feasible even with voltage drops of up to 48 volts per inch. The tunnel would, however, be slightly smaller in diameter.

Studies were also conducted to investigate methods of arc initiation. While various conventional methods, such as exploding wires, may be utilized, the preferred method for arc initiation incorporates moving the probe close to the coal seam. Arc initiation will be required whenever the arc breaks contact with the coal seam. Restriking the arc by having the probe 10 approach the coal seam C is the simplest and most reliable method investigated.

From the foregoing description of my invention, it will be realized that significant advantages are attained by the combined electro-thermal and electro-chemical underground conversion of coal. Advantageously, the substantially simultaneous application of an electric arc and steam and air mixture to the coal seam allows full control of the reaction temperature as well as the yield obtained. The process combination leads to the production of free H+ and OH— radicals that react on a molecular level to break down heavy tags and oils. The iron oxide and acid catalysts provide higher yields with greater production of saleable liquids. Advantageously, the steam sweep reduces the potential for uncontrolled underground fires. Additionally, the steam sweep serves to remove hydrocarbons from the tunnel to the bore hole. There a sump pump 70 removes the underground condensate, water, reaction materials and products so that pollution of water supplies is minimized.

Since the method allows the complete selection and limitation of the reaction path to a predetermined pattern, pillars of char may be left intact underground to act as roof support. In this way, subsidence of the overburden may be controlled and limited. Advantageously, the process may also be applied to seams that are more difficult and presently uneconomic to mine by any other methods. The process is also less expensive than conventional above-ground coal conversion technologies that require a number of expensive steps including the mining, transporting and processing of the coal. In summary, the method of the present invention offers a safe way to convert coal underground to a convenient form of clean energy.

The foregoing description of a preferred embodiment of the invention has been presented for purposes of illustration and description. It is not intended to be exhaustive or to limit the invention to the precise form disclosed. Obviously, many modifications and variations of the present invention are possible in light of the above teachings. The embodiment was chosen and described to provide the best illustration of the principles of the invention and its practical application to thereby enable one of ordinary skill in the art to utilize the invention in various modifications as are suited to the particular use contemplated. It is intended that the scope of the invention be defined by the claims appended hereto.

I claim:

1. A method for underground conversion of coal, comprising the steps of:

inserting a conversion probe into a bore hole until the probe is in close proximity to a coal seam;

supplying a mixture of at least air, steam, electrolyte, and catalyst for the electro-chemical conversion of the coal to the probe;

spraying the mixture directly on the coal seam;

substantially simultaneously energizing the probe with electricity to produce an arc between the probe and the coal seam, whereby the arc heat of combustion and the steam combine to produce a pyrolysis, an oxidation and a reduction of the coal, that converts the coal into a gaseous combination of oil and by-products; and extracting the gaseous combination of oil and by-products from the bore hole.

2. The method for underground conversion of coal as set forth in claim 1, further comprising the step of advancing the probe from the bore hole through the coal seam along a tunnel formed as the coal is converted.

3. The method for underground conversion of coal as set forth in claim 2, further comprising the step of rotating the electric arc substantially simultaneously with said spraying and energizing steps thereby providing improved conversion efficiency.

4. The method for underground conversion of coal as set forth in claim 2, further comprising the steps of:

repeating the advancing step in a different radial direction from the bore hole; and leaving the coal seam between the resulting tunnels undisturbed to minimize subsidence.

5. The method for underground conversion of coal as set forth in claim 4, further comprising the step of extending the tunnels until a rectangular area of the coal seam has been converted, thereby producing a modified star pattern of tunnels with the bore hole substantially at the center.

6. The method for underground conversion of coal as set forth in claim 5, further comprising the steps of:

drilling additional bore holes to repeat the modified star pattern so that the rectangular areas converted are contiguous; and repeating the modified star pattern to convert coal in a uniform manner over a large area while minimizing subsidence.

7. The method for underground conversion of coal as set forth in claim 5, wherein said electric arc has a voltage of from 1,000 to 2,000 volts and a current of at least 600 amperes and said rate of rotation of said arc is between 5 and 400 cycles per second.

8. The method for underground conversion of coal as set forth in claim 1, further comprising the step of separating the oil and by-products after extraction from the bore hole.

9. The method for underground conversion of coal as set forth in claim 8, wherein said separating step is accomplished by condensing the gaseous combination in a condenser to yield water and oil in a liquid form, and by-products in a gaseous form.

10. The method for underground conversion of coal as set forth in claim 9, further comprising the step of combusting the by-products to produce electricity for said energizing step.

11. The method for underground conversion of coal as set forth in claim 10, further comprising the step of heating water in a boiler with waste heat from said combustion step to produce the steam for said spraying step.

12. The method for underground conversion of coal as set forth in claim 1, wherein the electrolyte applied by said supplying step is an acid selected from the group consisting of nitric acid, sulfuric acid and hydrochloric acid.

13. The method for underground conversion of coal as set forth in claim 1, wherein the catalyst of said supplying step is selected from the group consisting of iron oxide, potassium salt, cobalt salt and calcium salt.

14. An apparatus for underground conversion of coal, comprising:

a conversion probe;

means for inserting the probe into a bore hole until the probe is in close proximity to a coal seam;

means for spraying a mixture of air, steam, and chemicals directly on the coal seam;

means for producing an electric arc between the probe and the coal seam, whereby the electric arc and the mixture convert the coal into a gaseous combination of oil and by-products; and means for rotating the electric arc while spraying the mixture so as to improve conversion efficiency.

15. The apparatus for underground conversion of coal as set forth in claim 14, further comprising means for monitoring the position of the probe within the tunnel.

16. The apparatus for underground conversion of coal as set forth in claim 15, wherein said means for monitoring comprises:

a plurality of sonic sensors mounted on the probe; and computer means for interpreting the output of the sonic sensors.

17. The apparatus for underground conversion of coal as set forth in claim 14, further comprising means for controlling electric arc current and voltage, electric arc rotation rate, probe advancing rate, and air, steam, electrolyte and catalyst supply rate.

18. The apparatus for underground conversion of coal as set forth in claim 14, further comprising means for pumping excess water accumulating in the bore hole from condensed steam and from subterranean sources, out of the bore hole.

* * * * *